United States Patent [19]

Sugioka et al.

[11] Patent Number: 4,765,552

[45] Date of Patent: Aug. 23, 1988

[54] DRIVE METHOD OF WINDER

[75] Inventors: Takami Sugioka; Yuzuru Miyake; Toshiyuki Ueno, all of Matsuyama, Japan

[73] Assignee: Teijin Seiki Company Limited, Osaka, Japan

[21] Appl. No.: 72,710

[22] Filed: Jul. 13, 1987

[30] Foreign Application Priority Data

Jul. 16, 1986 [JP] Japan ..... 61-165596

[51] Int. Cl.[4] ..... B65H 54/00; B65H 59/00; B65H 67/048

[52] U.S. Cl. ..... 242/18 R; 242/18 A; 242/18 DD; 242/36; 242/45

[58] Field of Search ..... 242/18 R, 18 A, 18 DD, 242/45, 36, 18 CS

[56] References Cited

U.S. PATENT DOCUMENTS

| | | | |
|---|---|---|---|
| 3,536,272 | 10/1970 | Ueyama | 242/45 |
| 3,717,311 | 2/1973 | Smith | 242/45 X |
| 4,069,985 | 1/1978 | Lohest et al. | 242/45 |
| 4,307,848 | 12/1981 | Barathieu | 242/18 R |
| 4,458,849 | 7/1984 | Miyake et al. | 242/18 R X |
| 4,685,629 | 8/1987 | Sugioka | 242/18 R |

*Primary Examiner*—Stanley N. Gilreath
*Attorney, Agent, or Firm*—Cushman, Darby & Cushman

[57] ABSTRACT

A drive method for the winding of a yarn wherein the yarn is wound on a bobbin holder and into a yarn package by contacting a contact roller with the package and controlling the number of rotations of the contact roller or tension of the yarn so as to be a predetermined value. When the contact roller is driven by an induction motor and also the contact roller is driven in pressing contact with the package by the induction motor, the number of rotations of the contact roller is given by the following equation: $N=n1-(K\cdot m\ (n0-n1)/T1)$, wherein the N indicates the number of rotations (r.p.m.) of the contact roller with which the contact roller is operated in pressing contact with the bobbin holder, the n0 indicates the number of rotations (r.p.m.) which is synchronized to the power frequency of the motor driving the contact roller, the n1 indicates the number of rotations (r.p.m.) of the motor with which only the contact roller is driven, the T1 indicates a load torque (kg cm) of the motor with which only the contact roller is driven, the m indicates the number of packages which are wound in contact with the contact roller, and the K is beween 0 and 1.5.

3 Claims, 8 Drawing Sheets

DRIVE METHOD OF WINDER

FIELD OF THE INVENTION

The present invention relates in general to a drive method of a winder of the spindle drive type.

SUMMARY OF THE INVENTION

In accordance with an important aspect of the present invention, yarn is wound on a bobbin holder and into a yarn package by contacting a contact roller with the package and controlling the number of rotations of the contact roller or tension of the yarn so as to be a predetermined value. A drive method of a winder according to the present invention, drives the contact roller using an induction motor and also drives the contact roller into pressing contact with the package using another induction motor. The number of rotations of the contact roller is given by the following equation:

$$N = n1 - (K \cdot m\ (n0 - n1)/T1),$$

wherein N indicates the number of rotations (r.p.m.) of the contact roller with which the contact roller is operated in pressing contact with the bobbin holder, the n0 indicates the number of rotations (r.p.m.) which is synchronized to the power frequency of the second motor driving the contact roller, the n1 indicates the number of rotations (r.p.m.) of the second motor with which only the contact roller is driven, the T1 indicates a load torque (kg cm) of the motor with which only the contact roller is driven, the m indicates the number of packages which are wound in contact with the contact roller, and the K is between 0 and 1.5.

DESCRIPTION OF THE PRIOR ART

In recent years, a winder tends to be made larger (for example, a length of the bobbin holder is more than 900 mm) and operated at higher speeds (for example, more than 5000 m/min).

The conventional winders of the above type are disclosed in Japanese patent publication No. 55-25583 and Japanese laid-open patent publication No. 58-78953.

In these conventional winders, the yarn is wound on a bobbin paper sleeve received on the bobbin holder and into a package by contacting a contact roller with the bobbin paper sleeve of the bobbin holder and controlling the number of rotations of the contact roller or tension of the yarn so as to be a predetermined value.

However, in the conventional methods of driving the winders, since the contact roller is caused to rotate about its own axis by the bobbin holder the following disadvantages occur when a force driving the contact roller is transferred to the contact roller by the bobbin holder:

(I) Since the driving force is transferred to the contact roller held in pressing contact with the bobbin paper sleeve of the bobbin holder, the bobbin paper sleeve tends to be ruptured by the driving force transferred to the contact roller by the bobbin holder. The term rupture in this case means separation of the outer layer of the bobbin paper sleeve and other abnormalities. In order to reduce the frequency of ruptures, it is necessary to use a high grade of bobbin paper sleeve. However, using a high grade of bobbin paper sleeve is expensive.

(II) Because of the driving force transferred to the contact roller by the bobbin holder, heat is generated in the contact portion between the contact roller and the yarn package, and the generation of heat causes yarn to be adhered with one another or yarn to be changed in quality thereby incurring an occurrence of dyed spots.

(III) In an automatic winder, when the contact roller is disengaged from the yarn package during rotation of a turret, the number of rotations of the contact roller is reduced, and as a result the yarn tends to loosen and/or be cut.

(IV) When the yarn is wound on the bobbin holder by contacting the contact roller having no driving force with the yarn package, the contact roller is driven by the driving force of the yarn package. This causes slight slips to occur between the contact roller and the package. These slips cause a speed difference between the yarn printed to the contact roller and the outer periphery of the yarn package. In a spinning drawn yarn of small elongation, the yarn is elongated by the transverse motion of the yarn and as a result changed in quality thereby incurring occurrence of dyed spots in the transverse end portion. Furthermore, even if the tension of the yarn from the feed roller to the contact roller is reduced to the minimum limit, the tension between the contact roller and the package is increased, and for this reason, there is the disadvantage that the package profile is uneven.

In order to analyze a mechanism causing the aforementioned disadvantages, the inventors have made various investigations and experiments with respect to the rupture of the bobbin paper sleeve, the occurrence of the dyed spots in the yarn, the number of packages contacting the contact roller and the contact area between the bobbin paper sleeve and the contact roller, and found the following facts.

The facts will be hereinafter explained in conjunction with FIGS. 8 and 9. In FIG. 8 are shown yarn quality test results with the evaluation of the yarn quality in five grades taken on the ordinate and with the load of the contact roller in kgcm/package taken on the abscissa. The load of the contact roller is obtained by dividing the driving force transferred to the contact roller from the side of the bobbin holder by the number of packages contacting the contact roller. Ten packages are evaluated and the numerical value enclosed within a circle indicates the number of packages corresponding to the evaluation. The evaluation of 3 to 5 shown in the hatched portion is equivalent to a higher grade of yarn. In FIG. 9 are shown rupture test results with time in minite taken on the ordinate and with load in kgcm/bobbin taken on the abscissa. When the bobbin paper sleeves of the grade shown in the following table 1 are operated at a speed of 6000 m/min, the times required until the bobbin paper sleeves are ruptured are plotted with respect to the values obtained by dividing the load driving the contact roller by the number of bobbins contacting the contact roller.

TABLE 1

| Mark indicated in FIG. 9 | Grade of bobbin paper sleeve |
|---|---|
| O | 4000 m/min |
| Δ | 6000 m/min |
| X | 8000 m/min |

The test results are obtained on the following conditions. The contact roller is contacted with the opposite ends of the bobbin per one bobbin, and the diameter of the opposite ends of the contact roller is slightly larger than the yarn package. It is noted a contact roller may also have a uniform diameter and even if the contact roller of uniform diameter is used, the test results would be the same. The contact pressure between the contact roller and the bobbin or yarn package is obtained by adding a mechanical sliding resistance to a value of contact pressure necessary for driving the load which is required to drive the contact roller.

From the aforementioned relations, the inventors have been fully assured that if the transferred load per one yarn package is less than a predetermined value (for example, 1.5 kgcm/package), a desired quality of yarn can be obtained. In addition, in the case that a bobbin paper sleeve is ruptured, if the limit of use is more than one minute, a bobbin paper sleeve of the grade of 4000 m/min can be used with less than 1.5 kgcm/min load.

It is, accordingly, the object of the present invention to provide an improved drive method of a winder which prevents a rupture of yarn, enhances a quality of yarn thereof and is inexpensive.

BRIEF DESCRIPTION OF THE DRAWINGS

The features and advantages of a drive method of a winder according to the present invention will be more clearly understood from the following description in which like reference numerals designate corresponding or similar members throughout the figures of the drawings and in which.

DESCRIPTION OF THE PREFERRED EMBODIMENT

Figure 1:
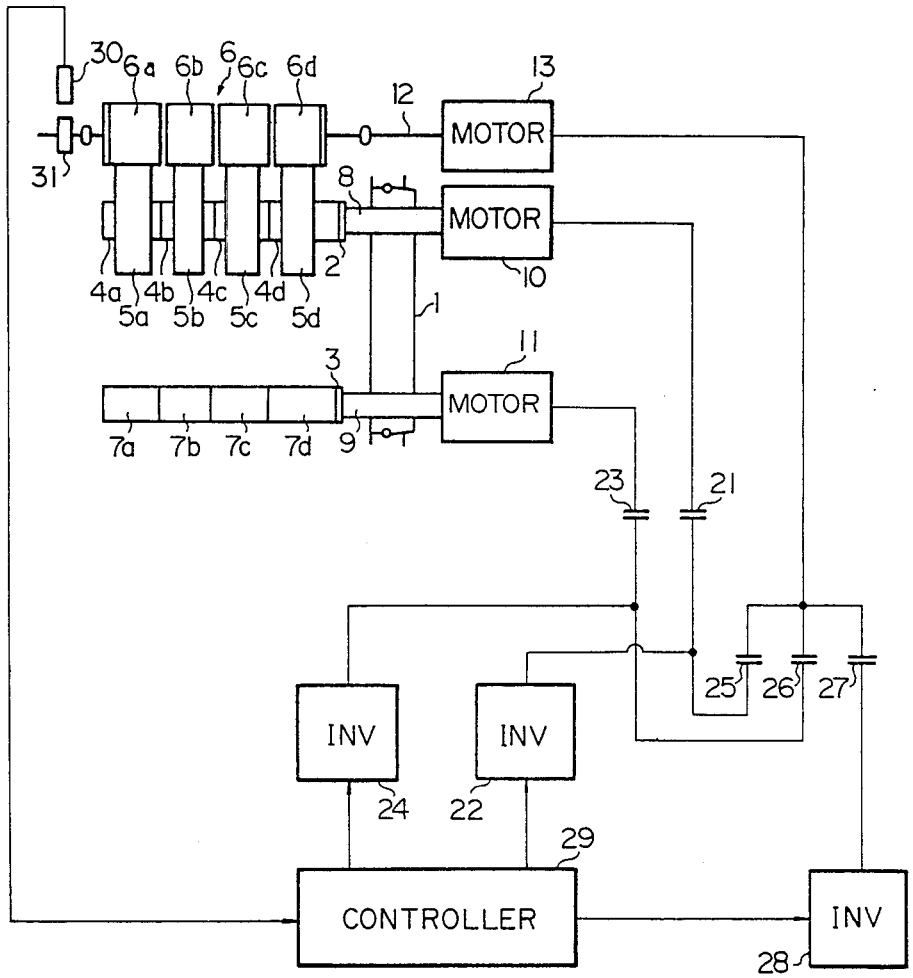
FIG. 1 is a generally schematic diagram showing a first embodiment of the winder to which the drive method of a winder according to the present invention is applied.

Referring first to FIG. 1 of the drawings, there is shown a first embodiment of the winder to which a drive method according to the present invention is applied. A turret table designated by reference numeral 1 is provided with first and second bobbin holders 2 and 3. The turret table 1 is rotatable in response to a turret command so that the relative positions of the first and second bobbin holders 2 and 3 are changed after the winding of a yarn is completed. The first bobbin holder 2 has four bobbins 4*a*, 4*b*, 4*c* and 4*d* mounted thereon, and these bobbins rotate with the bobbin holder 2. Yarn is wound on the bobbins 4*a*, 4*b*, 4*c* and 4*d*, and yarn packages 5*a*, 5*b*, 5*c* and 5*d* are formed on the bobbins 4*a*, 4*b*, 4*c* and 4*d*, respectively. Contact rollers 6*a*, 6*b*, 6*c* and 6*d* rotate in contact with the yarn packages 5*a*, 5*b*, 5*c* and 5*d* (hereinafter referred to as a "yarn package 5"), respectively. The contact rollers 6*a*, 6*b*, 6*c* and 6*d* are united in a single body. Likewise, the second bobbin holder 3 also has four bobbins 7*a*, 7*b*, 7*c* and 7*d* mounted thereon, and these bobbins rotate with the bobbin holder 3. In this embodiment, yarn is not wound on the bobbins 7*a*, 7*b*, 7*c* and 7*d*.

The first and second bobbin holders 2 and 3 are connected through drive shafts provided coaxially in supporters 8 and 9 to first and second motors (induction motors) 10 and 11, respectively, and similarly, contact rollers 6*a*, 6*b*, 6*c* and 6*d* (hereinafter referred to as a "contact roller 6") are also connected through a drive shaft 12 to a third motor 13. The first motor 10 is connectable through a relay 21 to an inverter 22, the second motor 11 is connectable through a relay 23 to an inverter 24, and the third motor 13 is connectable through relays 25 and 26 to the inverters 22 and 24, respectively, and through a relay 27 to an inverter 28. Electromagnetic switches and the like are employed as the relays 21, 23, 25, 26 and 28. The outputs of the inverters 22, 24 and 28 are controlled by a controller 29 to which is inputted a signal delivered from an electromagnetic pickup (detector) 30. The electromagnetic pickup 30 is disposed adjacent a gear 31 mounted on the drive shaft 12, and detects the number of rotations of the gear 31 to detect the number of rotations of the contact roller 6. According to the signal delivered from the electromagnetic pickup 30, the controller 29 delivers an optimum command in regard to an actuation of the contact roller 6, an actuating gradient with which the bobbin holders 2 and 3 are actuated, and a feedback control of the number of rotations of the contact roller 6 with which yarns are wound on the bobbins 4*a*, 4*b*, 4*c* and 4*d*, and the optimum command is delivered with a signal level to the inverters 22, 24 and 28. The command to the inverter 28 is automatically set by the controller 29 but may also be set manually. The inverters 22, 24 and 28 generate an AC electric power of the frequency corresponding to the command delivered from the controller 29, and supply the power to the motors 10, 11 and 13 through the relays 21, 23, 25, 26 and 27. It is noted that the motor 13 is first actuated by the inverter 22 or 24 for the bobbin holder 2 or 3 and thereafter connected through the relay 27 to the inverter 28.

The output frequency of the inverter 28 is set so that the number of rotations N of the contact roller 6 is within an optimum operating range given by the following equation (1):

$$N = n1 - (K \cdot m\ (n0 - n1)/T1) \qquad (1),$$

wherein the N indicates the number of rotations (r.p.m.) of the contact roller 6 with which the roller 6 is operated in pressing contact with the bobbin holder 2, the n0 indicates the number of rotations (r.p.m.) which is synchronized to the power frequency of the motor 13 driving the contact roller 6, the n1 indicates the number of rotations (r.p.m.) of the motor 13 with which only the contact roller 6 is driven, the T1 indicates a load torque (kg cm) of the motor 13 with which only the contact roller 6 is driven, the m indicates the number of packages 5 which are wound in contact with the contact roller 6 (in this embodiment, m=4), and the K indicates a torque (kg cm) transferred to the contact roller 6 from the bobbin holder 2 and is between 0 and 1.5.

The operation of the winder to which the drive method according to the present invention is applied will be hereinafter described in detail.

The contact roller 6 is brought into contact with the bobbins 4*a*, 4*b*, 4*c* and 4*d* mounted on the bobbin holder 2, and the motor 10 for the bobbin holder 2 is connected with the inverter 22 by closing the relay 21 and then the inverter 22 is actuated. At the same time, the motor 13 for the contact roller 6 is connected with the inverter 24 by closing the relay 26, and the inverter 24 is actuated. As a result, the actuation of the inverter 22 causes the motor 10 for the bobbin holder 2 to be rotated with the speed corresponding to the output frequency of the inverter 22, and the actuation of inverter 24 causes the motor 13 for the contact roller 6 to be rotated with the speed corresponding to the the output frequency of the inverter 24. At this time of the actuations, both the bobbins 4*a*, 4*b*, 4*c* and 4*d* and the contact roller 6 are actuated with the same actuating gradient which is set to a predetermined value so that a large torque does not act on the bobbins 4*a*, 4*b*, 4*c* and 4*d*, each held in contact with the contact roller 6.

When the rotation of the contact roller 6 actuated with the predetermined actuating gradient stabilizes, the relay 26 is opened and the relay 27 is closed, and as a result, the motor 13 for the contact roller 6 is disconnected with the inverter 24 and connected with the inverter 28, and by this inverter 28 is driven the motor 13 for winding. In this instance, the output frequency of the inverter 28 is set and controlled so that the number of rotations N of the contact roller 6 is within the optimum operating range given by the aforementioned equation (1).

Figure 2:
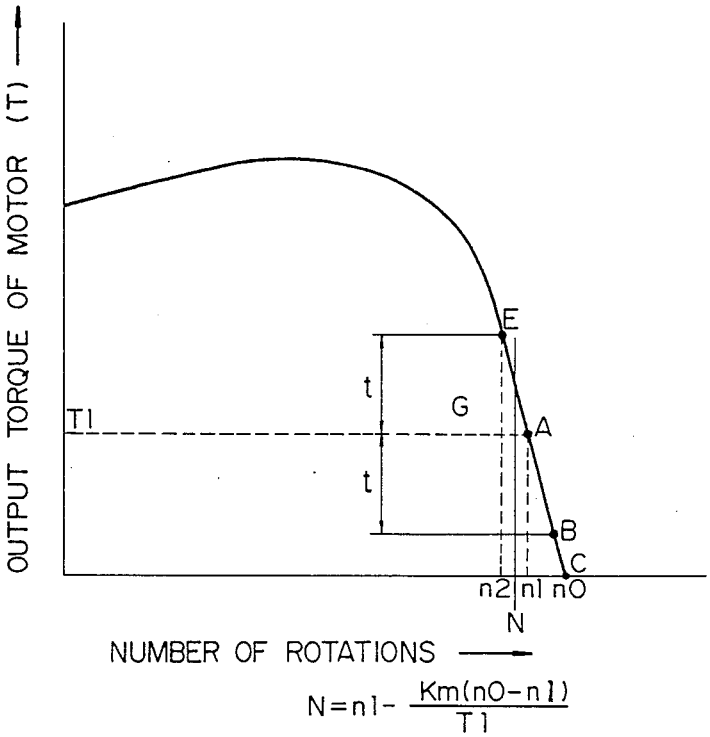
FIG. 2 is a diagram showing the relation between the output torque and the number of rotations of a motor for driving a contact roller shown in FIG. 1.

This control condition is shown in FIG. 2 with the output torque T of the motor 13 taken on the ordinate and with the number of rotations N taken on the abscissa. The point A indicated in FIG. 2 shows that when the motor 13 drives only the contact roller 6, the output torque and the number of rotations are T1 and n1, respectively. The point C indicated in FIG. 2 shows that when the motor 13 drives only the contact roller 6, the number of rotations synchronized to the power frequency of the motor 13 is n0. Strictly speaking, lines between the point A and the point C and between the point A and a point E of FIG. 2 are not straight lines, but can be assumed to be straight lines. With such assumption, a torque t allowable with respect to the rupture of the aforementioned yarn quality and the rupture of the bobbin paper sleeve is given by the following equation (2):

$$0 \leqq t \leqq 1.5\ m \qquad (2).$$

When the load applied to the contact roller 6 is taken into consideration, that is, N=n1, an upper limit n2 of the number of rotations of the motor 13 corresponds to the point E indicated in FIG. 2, and is given by the following equation (3):

$$n2 = n1 - (n0 - n1)t/T1 \qquad (3).$$

Accordingly, the operating region within the allowable torque t is between the points A and E, that is, between the n1 (r.p.m.) and the n2 (r.p.m.). In this instance, in the direction from the point A to the point E and also in the opposite direction from the point A and the point B, there are the regions wherein the torque acting on the package 5 or the bobbin 4 is within the allowable torque t. However, in controlling the number of rotations of the bobbin holder 2 so that the number of rotations of the contact roller 6 or the tension of the yarn to be wound is a predetermined value, when the yarn is wound by contacting the contact roller having no driving force with the package, the contact roller is driven by the driving force of the package, but since slight slips occur between the contact roller and the package, there is a speed difference between the yarn printed to the contact roller and the outer periphery of the package. For this reason, in a spinning drawn yarn of small elongation, the yarn is elongated by the traverse motion of the yarn and as a result changed in quality thereby incurring occurrence of dyed spots in the traverse end portion. Furthermore, even if the tension of the yarn from the feed roller to the contact roller is reduced to the minimum limit, the tension between the contact roller and the package is increased, and for this reason, there is the disadvantage that the package profile is uneven. Accordingly, the region between A and B is excluded from the optimum operating region.

From the foregoing descriptions, it will be seen that the optimum operating range which meets the allowable torque t taking the yarn quality and the like into consideration, is between the point A and a point G indicated in FIG. 2. That is, the optimum operating range is the range between the n1 and the n2 (FIG. 2) which are given by the aforementioned equation (1).

Thus, since the motor for driving the contact roller is operated within the optimum range of a predetermined torque and at the same time with the condition that a torque of plus direction acts in the direction from the motor driving the contact roller to the motor driving the bobbin holder, that is, with the condition that the motor driving the contact roller bears a part of the load of the contact roller and a part of the load of the bobbin holder, the occurrence of dyed spots caused in the yarn by the driving force and the rupture of the bobbin are effectively prevented, and the dyed spots of the yarn and the uneven profile of the yarn package due to the circumferential speed between the contact roller and the package caused by slips are effectively prevented. It is noted that it is preferable that the number of rotations of the contact roller be set so that the value of the K of the aforementioned equation (1) is between 0 and 1.0.

When the yarn package 5 wound on the bobbin 4 reaches a predetermined amount, the relay 23 is first closed and the motor 11 is actuated by the inverter 24, and then the turret table 1 is rotated so that the relative positions of the first and second bobbin holders 2 and 3 are changed. Thereafter, the number of rotations N of the contact roller 6 is detected by the electromagnetic pickup 30, and the motor 11 is controlled by the controller 29 so that the speed of the contact roller 6 is a predetermined value N. During the control of the motor 11, the contact roller 6 driving the motor 13 is controlled by the inverter 28, and this control continues until the winder is brought into a stop.

The effect of the aforementioned first embodiment of the present invention will be hereinafter compared with the aforementioned prior art from the standpoint of the aforementioned disadvantages (I), (II), (III) and (IV).

With respect to the (I):

Although the contact roller 6 is in pressing contact with the bobbin 4, the driving force for driving the contact roller 6 is used as a driving force for a speed control, and the contact roller 6 is rotated within the optimum operating range given by the aforementioned equation (1). Accordingly, the rupture of the bobbin paper sleeve caused by the driving force transferred to the contact roller 6 by the bobbin holder is effectively prevented, and a lower grade of bobbin paper sleeve can be used, thereby resulting in reduction in the cost of running the winder.

With respect to the (II):

Since the driving force for driving the contact roller 6 is small, heat does not generate in the contact portion between the contact roller and the yarn package. Accordingly, there is not the disadvantage that the generation of heat causes yarns to be adhered with one another or yarns to be changed in quality thereby incurring occurrence of dyed spots. Thus, the quality of yarn is enhanced. In addition, since the contact roller itself is driven, the driving force to be transferred to the contact roller 6 from the bobbin 4 is small, and therefore the organization of the yarn is not damaged by the contact pressure between the contact roller 6 and the bobbin 4, thereby enhancing the quality of yarn. Furthermore, since the driving force transferred to the contact roller is small, the contact pressure between the contact roller 6 and the bobbin 4 can be reduced, thereby enhancing the package profile.

With respect to the (III):

In the present invention, when the contact roller is disengaged from the yarn package after the yarn is wound into the yarn package, the number of rotations of the contact roller is not reduced, the looseness and cut of the yarn can be prevented. As a result, occurrence of waste yarns can be considerably reduced.

With respect to the (IV):

In the case that the yarn is wound on the bobbin holder by contacting the contact roller having no driving force with the yarn package, the contact roller is driven by the driving force of the yarn package, and for this reason, slight slips occur between the contact roller and the package. However, in the present invention, since a driving force of plus direction acts slightly from the contact roller to the bobbin holder, the yarn between the contact roller and the package relaxes, thereby preventing an elongation of the yarn and enhancing the package profile.

Although, in the first embodiment, the contact roller 6 is actuated by the inverter which supplies an electric power to the motor 11 for driving the bobbin holder 3, it is noted that, after the contact roller is actuated by an additional inverter for actuation, it may also be operated by an inverter which operates a plurality of winders. Also, while it has been described that the T1 of the aforementioned equation (1) is the load torque of the motor 13, it is noted that it may also be a current or slip rate of the motor 13.

Figure 3:
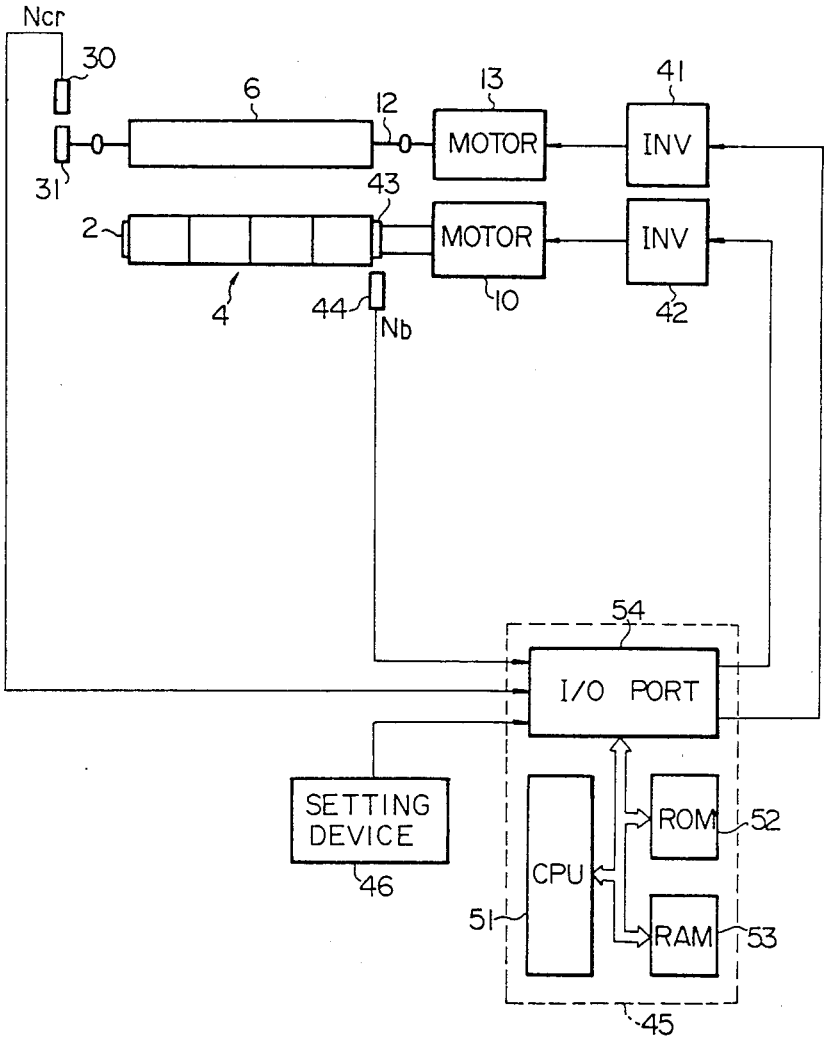
FIG. 3 is a generally schematic view showing a second embodiment of the winder to which the drive method of a winder according to the present invention is applied.
Figure 4:
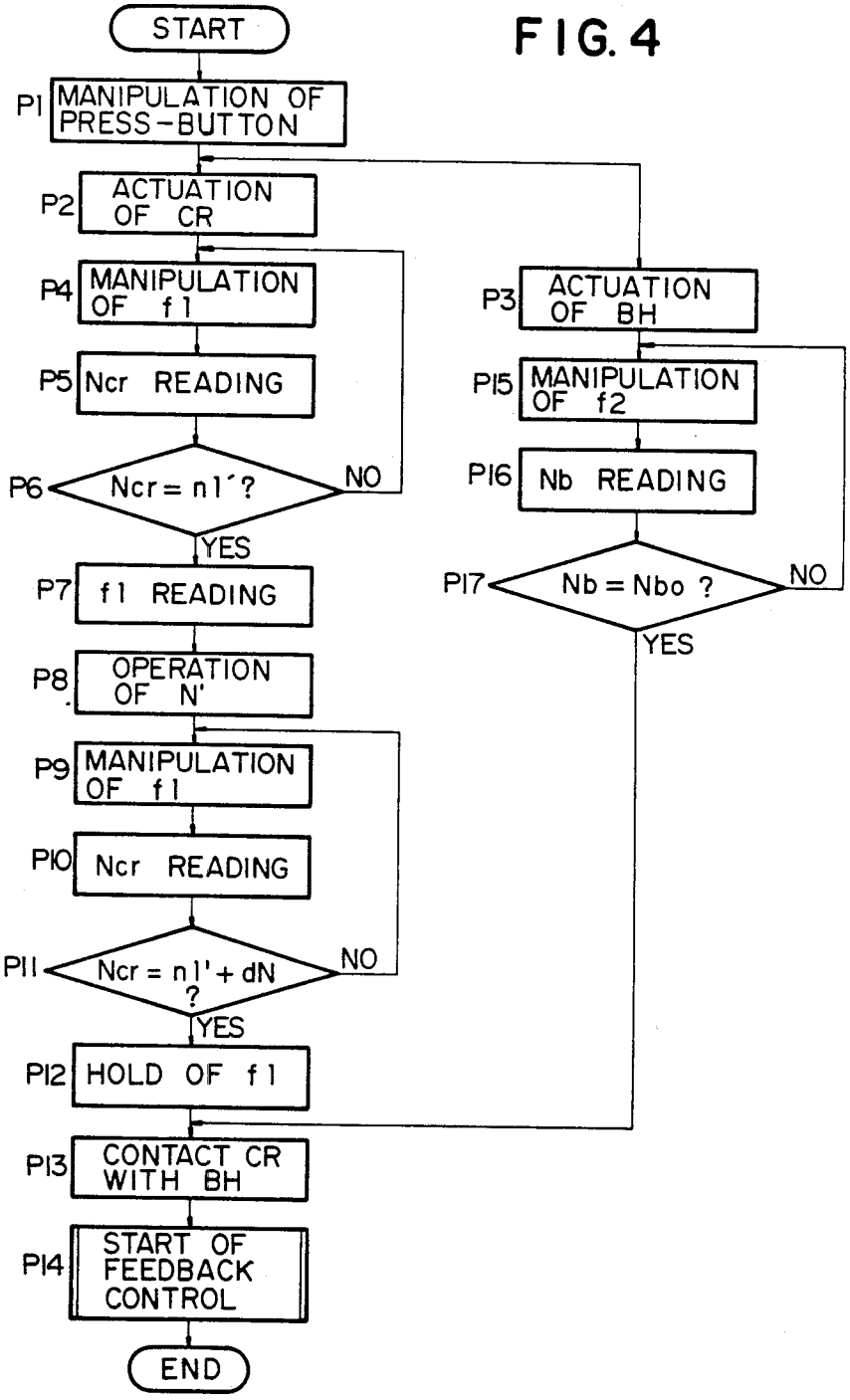
FIG. 4 is a block diagram showing a program for driving the winder shown in FIG. 3 in accordance with the present invention.

Referring to FIGS. 3 and 4, there is shown a second embodiment of the winder to which the drive method according to the present invention is applied. In this embodiment, the winder is of the manual type. While, in the first embodiment, the contact roller is actuated in contact with the bobbin holder, it is noted that the contact roller may also be actuated in non-contact with the bobbin holder and that the optimum inverter frequency can also be calculated by a microcomputer in accordance with the number of rotations of the contact roller during the operation and with the frequency of the inverter. The members corresponding to those of the first embodiment are designated by like reference numerals to avoid the description.

In FIG. 3, an electric power of a first inverter 41 is supplied to a motor 13 for driving a contact roller 6, and an electric power of a second inverter 42 is supplied to a motor 10 for driving a bobbin holder 2. It is noted that the motor 10 for driving the bobbin holder 2 is not always limited to an induction motor. An electromagnetic pickup 30 is arranged adjacent a gear 31 mounted on a drive shaft 12 to detect the number of rotations Ncr of the contact roller 6. Likewise, a pulse pickup 44 is arranged adjacent a gear 43 mounted on the bobbin holder 2 to detect the number of rotations Nb of the bobbin holder 2. The outputs of the electromagnetic pickup 30 and 44 are inputted to a microcomputer 45, and furthermore, to the microcomputer 45 is also inputted an output of a setting device 46. The setting device 46 is adapted to set a winding speed of yarn, the number of packages and the like, and the setting is made manually by the operator.

The microcomputer 45 comprises a central processing unit 51 labelled as "CPU", a read-only memory 52 labelled as "ROM", a random access memory 53 labelled as "RAM" and an input-output port 54 labelled as "I/O port". The CPU 51 has received therein external datum which are necessary in accordance with programs read on the ROM 52, and processes values necessary for the yarn winding control, giving and receiving datum between the CPU 51 and the RAM 53. The processed values are transferred from the CPU 51 to the I/O port 54. The I/O port 54 receives signals from the electromagnetic pickups 30 and 44 and a signal from the setting device 46 and delivers command signals to the inverters 41 and 42. The ROM 52 has stored therein programs and datum in the CPU 51. The RAM 53 temporary memorizes external information and datum to be used in operation.

FIG. 4 is a block diagram showing a program for a winding control carried out by the microcomputer 45.

Figure 5:
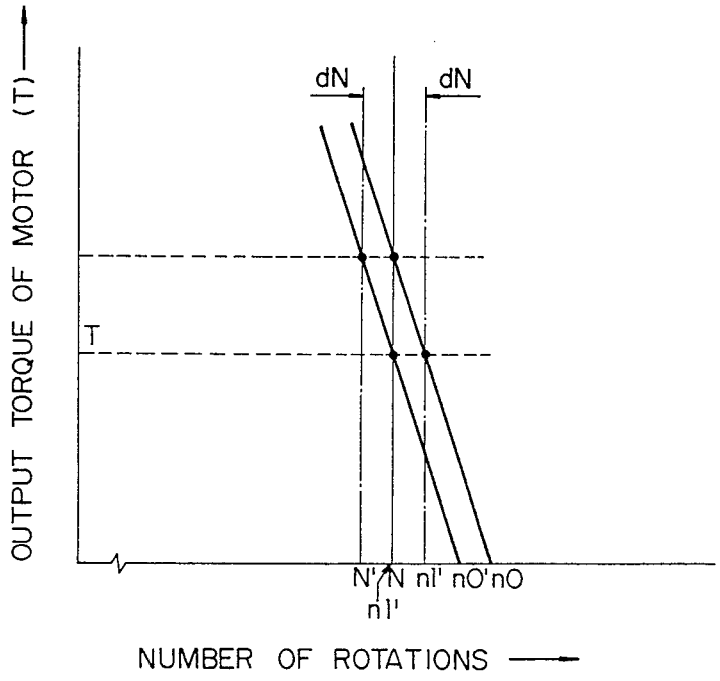
FIG. 5 is a diagram for explaining the operation of the second embodiment.

First, the control of the contact roller 6 will be explained. The program starts by manipulation of a pressbutton (PB) which actuates the winder at a step P1. At a step P2, the contact roller (CR) 6 is actuated, and at a step P4, an output frequency f1 of the inverter 41 is increased with a predetermined actuating gradient. As a result, the contact roller 6 increases the speed of rotation thereof and approaches a winding speed. At a step P5, the number of rotations Ncr of the contact roller 6 is read from the number of rotations of the drive shaft 12 detected by the electromagnetic pickup 30, and at a step P6, the number of rotations Ncr is compared with a temporary predetermined number of rotations n1 (=n1'). It is noted that the n1' is set in accordance with the winding speed and the diameter of the contact roller 6. When the Ncr is not equal to the n1', the step P6 is returned back to the step P4. When, on the other hand, the Ncr is equal to the n1', the step P6 goes to a step P7. At the step P7, the output frequency f1 of the inverter 41 is read, and at a step P8, a target value N' corresponding to the optimum operating region given by the aforementioned equation (1) is calculated. At a step P9, the output frequency f1 of the inverter 41 is manipulated so that the number of rotations of the contact roller 6 is increased until N=n1'+dN (FIG. 5), and at a step P10, the number of rotations Ncr of the contact roller 6 is read again. At a step P11, the Ncr is compared with the (n1'+dN). When the Ncr is not equal to the (n1'+dN), the step P11 is returned back to the step P9. When, on the other hand, the Ncr is equal to the (n1'+dN), the output frequency f1 of the inverter 41 is held at a step P12. At a step P13, the contact roller 6 is brought into contact with the bobbin holder 2. Thus, the temporary n1' is calculated in accordance with the following equation (4):

$$n1' = V/\pi D \quad (4),$$

wherein the D indicates the outer diameter of the contact roller 6 and the V indicates the winding speed. From the calculated n1' is obtained a temporary N', and furthermore a dN is obtained by (N'−n1'). As shown in FIG. 5, since the dN is extremely small, it can be assumed that a torque characteristic of the motor 13 is substantially the same even if shifted by the dN. With such assumption, the f1 is increased from n0' to n0.

Next, the control of the bobbin holder 2 will be explained. The aforementioned step P1 goes to a step P3, and at the step P3, the bobbin holder (BH) 2 is actuated. At a step P15, an output frequency f2 of the inverter 42 for the bobbin holder 2 is increased with a predetermined actuating gradient. As a result, the bobbin holder 2 increases the speed of rotation thereof and approaches the winding speed. At a step P16, the number of rotations Nb of the bobbin holder 2 is read, and at a step P17, the Nb is compared with a predetermined number of rotations Nbo. The Nbo is the number of rotations with which the contact roller 6 is contacted with the bobbin holder 2, and set to an optimum value in advance. When the Nb is not equal to the Nbo, the step P17 is returned back to the step P15. When, on the other hand, the Nb is equal to the Nbo, the step P17 goes to the step P13.

After the contact roller 6 is contacted with the bobbin holder 2 at the step P13, the feedback control of the motor 10 for driving the bobbin holder 2 is carried out at a step 14 so that the number of rotations Ncr of the contact roller 6 becomes the target value N. This control is done by manipulating the output of the inverter 42 by a PID control while reading the number of rotations Ncr of the contact roller 6.

Thus, the drive method according to the present invention can also be put into practice by the use of a microcomputer, and the second embodiment is able to obtain the same effect as the first embodiment.

Figure 6:
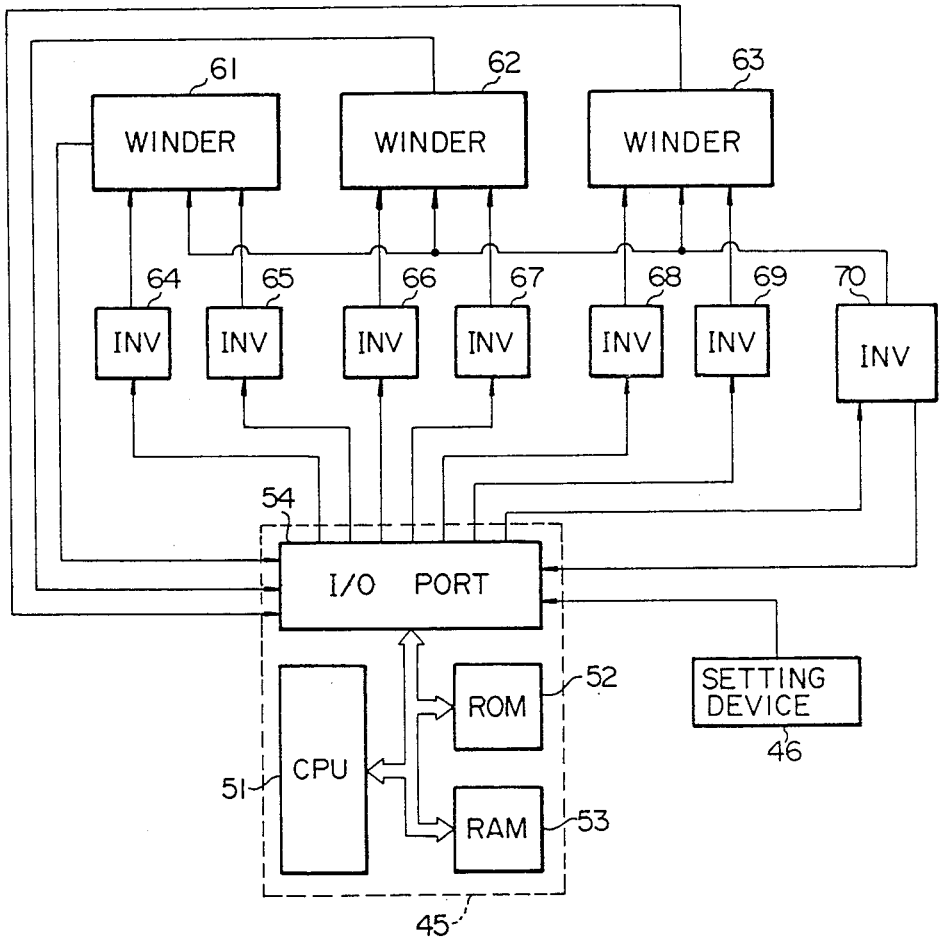
FIG. 6 is a generally schematic view showing a third embodiment of the winder to which the drive method of a winder according to the present invention is applied.
Figure 7:
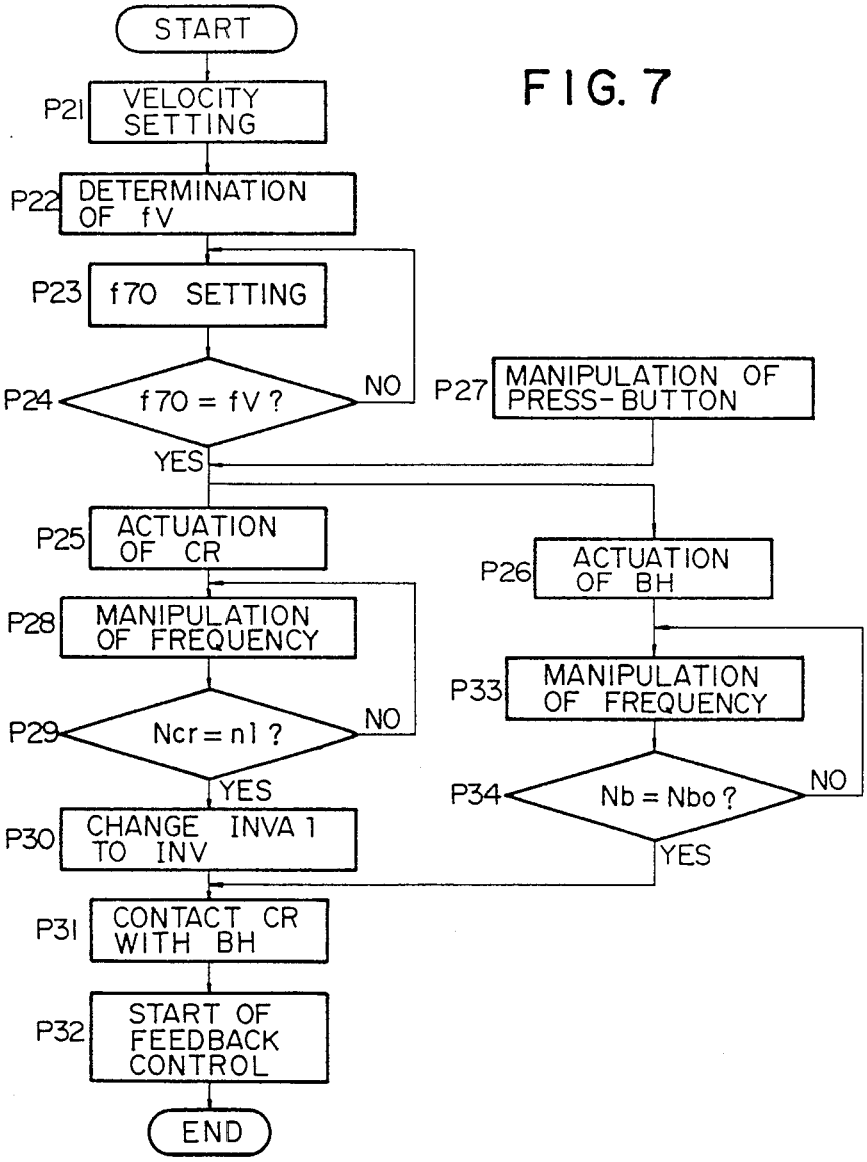
FIG. 7 is a block diagram showing a program for driving the winder shown in FIG. 6 in accordance with the present invention.
Figure 8:
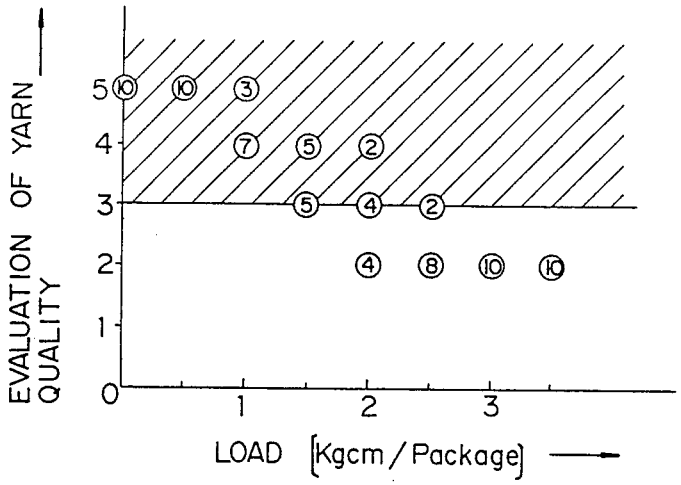
FIG. 8 is a diagram showing the relation between the quality of a yarn to be wound and the load driving a contact roller in order to explain the operation of the present invention.
Figure 9:
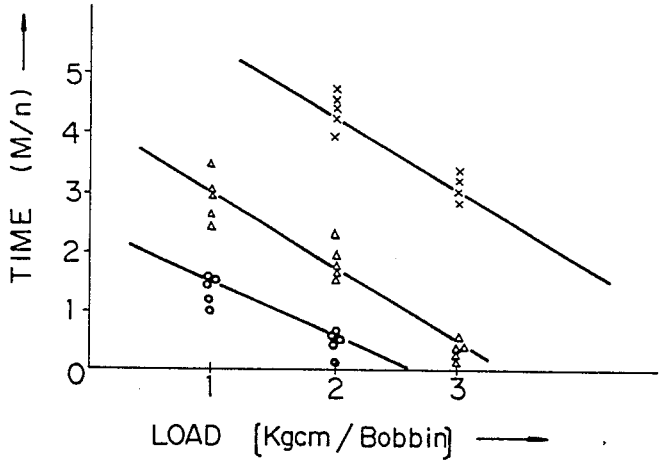
FIG. 9 is a diagram showing the relation between the time required until a bobbin paper sleeve is ruptured and the load driving a contact roller in order to explain the operation of the present invention.

Referring to FIGS. 6 and 7, there is shown a third embodiment of the drive method according to the present invention. The members corresponding to those of the first embodiment are designated by like reference numerals to avoid the description. In this embodiment, a plurality of winders 61, 62 and 63 are controlled. The winder 61 is provided with inverters 64 and 65, the winder 62 is provided with inverters 66 and 67, and the winder 63 is provided with inverters 68 and 69. The winders 61, 62, 63 and an inverter 70 are connected with a microcomputer 45. The microcomputer 45 feeds back and controls the number of rotations Ncr of the contact roller 6, and outputs an command to each of the inverters 64 through 70.

FIG. 7 is a block diagram showing a program for carrying out the third embodiment of the drive method according to the present invention. At a step P21, a winding speed V is set, and at a step P22, an output frequency fv of the inverter 70 is determined in accordance with the winding speed V. A f70 is calculated in accordance with a predeterminedly programmed value corresponding to the winding speed V set at the step P21. At a step P23, the output frequency f70 of the inverter 70 is set to the determined value fv (f70=fv), and at a step P24, the present output frequency f70 is compared with the determined value fv. When the f70 is not equal to the fv, the step P24 returns back to the step P23, and when the f70 is equal to the fv, the step P24 goes to steps P25 and P26. Furthermore, besides the step 24, a step P27 for processing manipulation of a press-button is added to the steps P25 and P26.

At a step P25, the respective contact rollers 6 of the winders 61, 62 and 63 are actuated by the inverters 64, 66 and 68, respectively, and at a step P28, output frequencies of the inverters 64, 66 and 68 are increased. At a step P29, the number of rotations Ncr of the contact roller 6 is compared with a predetermined number of rotations n1. When the number of rotations Ncr of the contact roller 6 is not equal to the predetermined number of rotations n1, the step P29 returns back to the step P28. When the number of rotations Ncr of the contact roller 6 is equal to the predetermined number of rotations n1, the step P29 goes to a step P30. At the step P30, the power supply from the inverters 64, 66 and 68 is brought into a stop, and a power is supplied to the winders 61, 62 and 63 from the inverter 70, and the step P30 goes to a step P31.

On the other hand, at the step P26, the respective bobbin holders 2 of the winders 61, 62 and 63 are actuated by the other inverters 65, 67 and 69, and at a step P33, output frequencies of the inverters 65, 67 and 69 are increased. At a step P34, the number of rotations Nb of the bobbin holder 2 is compared with a predetermined number of rotations Nbo. When the number of rotations Nb is not equal to the number of rotations Nbo, the step P34 returns back to the step P33. When the number of rotations Nb is equal to the number of rotations Nbo, the step P34 goes to the step P33. The step P31 and a step P32 are substantially identical to the steps P13 and P14 of the second embodiment.

Thus, the third embodiment is substantially identical to the first embodiment in the command to the inverter 70, and advantageous over the first embodiment in that a plurality of the winders 61, 62 and 63 are controlled effectively by a single microcomputer. While the third embodiment has been described in conjunction with three winders, it is noted that the present invention may also be applied to more than three winders. Also, the motor for driving the contact roller may be of the normal type or of the high resistance type. Furthermore, it is noted that, after the contact rollers are each actuated by an inverter for actuation common to a plurality of winders, they may be operated during winding by an additional inverter common to the plurality of winders.

From the foregoing descriptions, it will be seen that, in accordance with the present invention, there is provided an improved drive method of a winder which prevents a rupture of yarn, enhances a quality of yarn and is inexpensive.

While certain representative embodiments and details have been shown for the purpose of illustrating the invention, it will be apparent to those skilled in this art that various changes and modifications may be made therein without departing from the spirit or scope of the invention.

What we claim is:

1. A drive method of a winder for winding a yarn on a bobbin holder, comprising the steps of:

bringing a contact roller into contact with said bobbin holder, rotating said bobbin holder using a first motor, rotating said contact roller using a second motor, and controlling said rotations of said first and second motors such that the number of rotations of said contact roller is given by the following equation:

$$N=n1-(K\cdot m\ (n0-n1)/T1),$$

wherein N indicates the number of rotations (r.p.m.) of said contact roller which is operated in pressing contact with said bobbin holder, n0 indicates the number of rotations (r.p.m.) which is synchronized to the power frequency of said second motor driving said contact roller, n1 indicates the number of rotations (r.p.m.) of said second motor with which only said contact roller is driven, T1 indicates a load torque (in kg-cm) of said second motor with which only said contact roller is driven, m indicates the number of packages which are wound in contact with said contact roller, and K is between 0 and 1.5.

2. A drive method as set forth in claim 1, wherein said T1 of said equation indicates a current of said second motor for rotating the contact roller.

3. A drive method as set forth in claim 1, wherein said T1 of said equation indicates a slip rate of said second motor for rotating the contact roller.

* * * * *